United States Patent [19]

Jauch et al.

[11] Patent Number: 4,664,532

[45] Date of Patent: May 12, 1987

[54] ASSEMBLY FOR FASTENING THE CLOCKWORK AND THE GONGBLOCK OF A CLOCK IN A HOUSING

[75] Inventors: Hermann Jauch, Deisslinger; Kurt Nopper, Bad-Duerrheim/Oefingen, both of Fed. Rep. of Germany

[73] Assignee: Gebruder Jauch K.G. Clock Factory, Deisslingen, Fed. Rep. of Germany

[21] Appl. No.: 691,763

[22] Filed: Jan. 16, 1985

[30] Foreign Application Priority Data

Jan. 19, 1984 [DE] Fed. Rep. of Germany ..... 3401688

[51] Int. Cl.[4] ..... G04B 21/00

[52] U.S. Cl. ..... 368/273; 368/276

[58] Field of Search ..... 368/264, 272, 276, 277, 368/273

[56] References Cited

U.S. PATENT DOCUMENTS 1,715,521 6/1929 Summers ..... 368/277

1,832,658 11/1931 Reeves ..... 368/272

2,062,895 12/1936 Luzo ..... 368/264

FOREIGN PATENT DOCUMENTS 566498 12/1932 Fed. Rep. of Germany ..... 368/272

1215599 4/1966 Fed. Rep. of Germany .

*Primary Examiner*—Bernard Roskoski

*Attorney, Agent, or Firm*—Schwartz, Jeffery, Schwaab, Mack, Blumenthal & Evans

[57] ABSTRACT

In order to facilitate the insertion and adjustment of a clockwork and a gongblock in the housing of a clock, the gongblock and the clockwork mechanism are fixed on to a common mounting means which is fastened to the housing. The assembly and adjustment can be carried out outside of the housing before insertion. The gongblock is cast in one piece with the mounting means. The clockwork is fastened to the mounting means by lengthwise adjustable supports so that it may be fit to variable housing depths.

8 Claims, 1 Drawing Figure

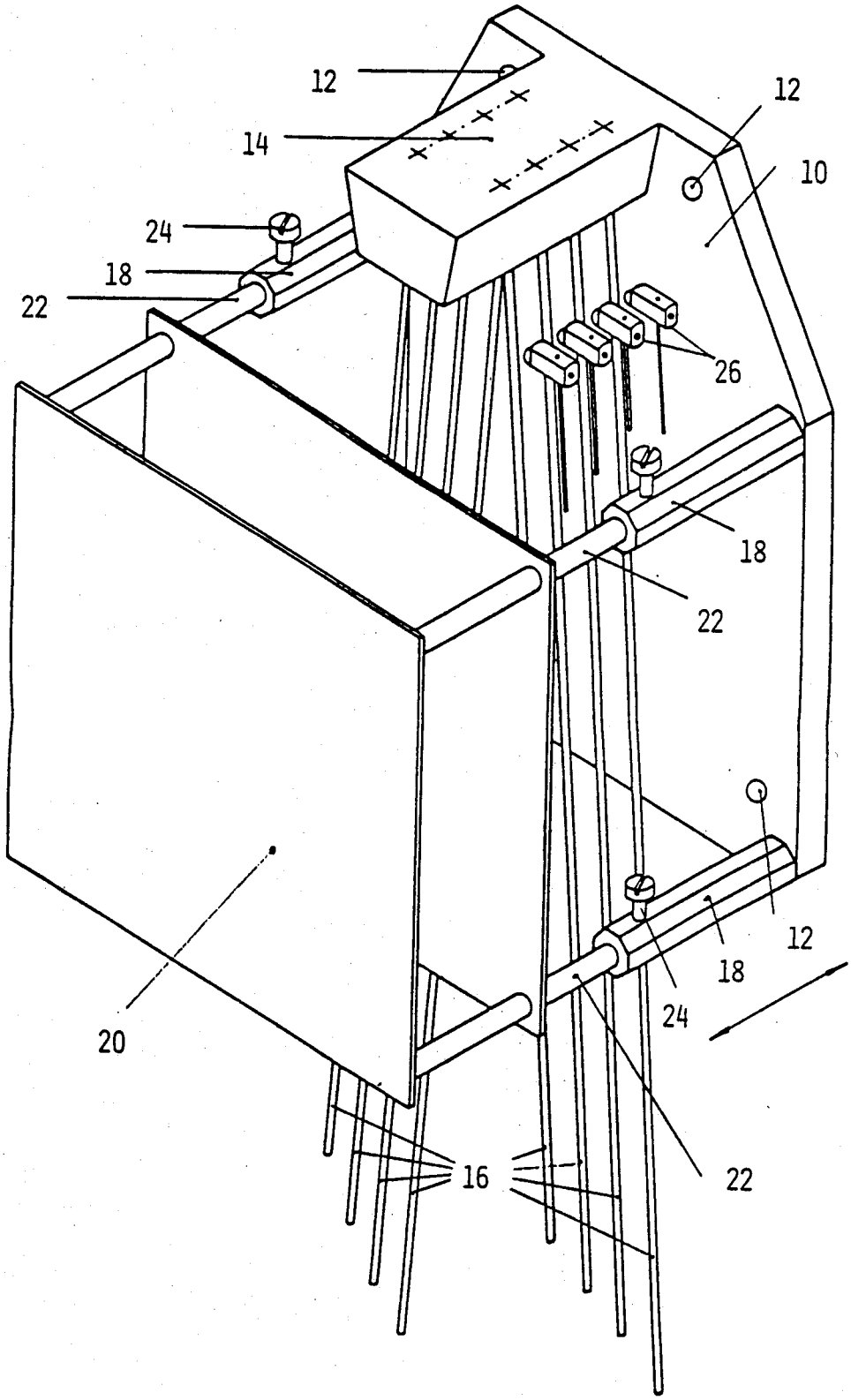
12
14
12
10
24
18
22
26
18
22
12
18
24
20
16
22

ASSEMBLY FOR FASTENING THE CLOCKWORK AND THE GONGBLOCK OF A CLOCK IN A HOUSING

BACKGROUND OF THE INVENTION

The invention relates as indicated to an assembly for fastening the clockwork and the gongblock of a clock in a housing.

In known clocks with gong striking mechanisms, the clockwork with the hammers, and the gongblock which carries the gong rods, are fastened in the housing independent of one another. A wheel work board, a support seat, or fastening tabs serve to fasten the clock mechanism. The separate fastening of the clock mechanism and the gongblock and the respective alignment and adjustment make the installation of the clockwork and the gongblock difficult and labor intensive.

The clock mechanism, with its clock face and hands, must first be fastened on the wheelwork board, the support seat, or fastening tabs, respectively, in order to be fastened in the housing. The clockwork is put into the housing and aligned. The fastening points are then marked in the housing. Thereafter, the clockwork is removed again in order that the fastening holes may be bored. The clockwork is then once again set into the housing and must be newly aligned. Next, the first hammer is adjusted against its corresponding gong rod inside the housing. The clock mechanism is again taken out in order to align the remaining hammers. Only then can the clockwork finally be inserted and fastened after an additional check and possibly further adjustment.

SUMMARY OF THE PRESENT INVENTION

It is an object of the present invention to provide an assembly by means of which the installation and adjustment of a clockwork and gongblock is significantly facilitated and simplified by mounting the clockwork and the gongblock on a common plate which may be fastened in the housing of the grandfather clock. The clockwork is fastened onto the plate outside of the housing. The adjustment of the hammers on the gong rods can also take place outside of the housing. This adjustment is greatly facilitated by better accessibility and visibility. Only when the clockwork is completed and adjusted is it inserted and fastened in the housing by means of the plate.

Since the clockwork and the gongblock no longer need to be fastened separately in the housing, only the plate need be fastened. Thus, a smaller number of fastening holes is required, and screwing in is simplified.

The gongblock is preferably produced in a cast iron casting in one piece with the plate. The assembly is thereby further simplified because the gongblock is no longer required to be fastened to the plate. In particular, the casting mass of the gongblock is increased by about 25% by the plate, so that the resonance quality of the gong is significantly improved.

The clock mechanism is preferably fastened to the plate by means of supports of adjustable length. The distance between the clock mechanism and the ground plate can thereby be advantageously adjusted and fixed without steps for a fit to the depth of the housing in the clock.

A simple construction of stepless, length adjustable supports can be achieved by fastening hollow columns to the plate. Rods, fastened to the clockwork, slide into these hollow columns and are fixedly held by radial screws. This stepless fit allows the same plate and the same clockwork mechanism to be utilized for the most variable housing depths.

The assembly according to the invention may be used with all arrangements of clockwork mechanisms and gongs. The gong striking arrangement can be located behind the clockwork mechanism, that is, between the clockwork and the plate. Just as well, the gong striking arrangement can be located in the same plane as the clockwork mechanism, next to the same, or under it.

BRIEF DESCRIPTION OF THE APPLICATION DRAWING

The drawing comprises a single figure showing an assembly according to the invention, in perspective representation. In the embodiment shown, the gong striking arrangement is located behind the clockwork mechanism.

DETAILED DESCRIPTION OF THE PREPARED EMBODIMENT

A mounting or base plate 10 is provided with four bore holes 12 which allow the ground plate 10 to be fastened to the back wall of the housing of the clock by means of screws (not shown). A gongblock 14 is provided at the top of the plate 10, on which the gong rods 16 are suspended. The gongblock 14 and the plate 10 are composed of cast iron and are preferably cast in one piece.

Underneath the gongblock 14, four spaced hollow columns 18 are attached at the four corners of the plate, and extend perpendicular to the plate.

A conventionally designed clockwork mechanism 20, of which only the front and back plates are shown, is provided with rods 22 at each of the four corners of the mechanism. The rods may be pushed into the hollow columns 18. The rods 22 are telescopically received within the columns 18, and may be fixed in any desired position in the columns by means of screws 24 which are radially screwed into the hollow columns 18. The rods 22 are in the form shown cylindrical, with the columns being formed with cylindrical bores. However, it will be apparent that other shapes could be utilized as well to accommodate the telescopic movement.

In order to insert the clockwork mechanism and the striking mechanism into the housing of the clock, the clock face and the hands of the clockwork mechanism 20 are assembled. The clockwork mechanism 20 is then pushed into the hollow columns 18 by means of the rods 22 and a position corresponding to the depth of the housing of the clock is fixed by means of the screws 24. The hammers 26 of the clockwork are then aligned with the gong rods 16 so that the entire system is completely assembled and aligned. The hammers 26 are mounted on the clockwork mechanism in a manner well known in the art and accordingly not illustrated in the application drawing. The entire assembly and adjustment may take place outside of the housing of the clock where it is possible to gain unhindered access for aligning the hammers. The completely assembled and adjusted system is then set into the housing, and aligned and fastened to the housing by four screws which fit through the holes 12 into engagement with the clock housing.

It is claimed:

1. An assembly for fastening the clockwork and the gongblock to the wall of a clock housing, comprising;

(a) a mounting plate adapted to be rigidly secured to the back wall of the housing;

(b) a gongblock rigidly secured directly to said mounting plate, said gongblock carrying chime rods;

(c) a clockwork mechanism; and (d) mounting means secured respectively to said clockwork mechanism and said mounting plate for mounting said clockwork mechanism directly on said mounting plate at a predetermined spacing therefrom, and wherein (e) said mounting plate, gongblock, and clockwork mechanism can be preassembled and said mounting plate thereafter mounted on said housing wall.

2. The assembly according to claim 1, wherein said gongblock is integrally formed with said mounting plate.

3. The assembly according to claim 2, wherein said mounting plate and said gongblock are composed of cast iron.

4. The assembly according to claim 1, wherein said means for mounting said clockwork mechanism on said mounting plate comprises hollow columns secured to said mounting plate, and rods secured to the clockwork mechanism and telescopically interconnected with said column in such a manner that said rods may be pushed into the hollow columns to the desired depth depending on the desired front to rear dimension of the assembly, and means for retaining said rods in their telescopically adjusted positions.

5. The assembly of claim 1, wherein said mounting plate and said gongblock are metallic and integrally formed.

6. The assembly of claim 5, wherein said plate and gongblock are cast in one piece.

7. The assembly of claim 5, wherein said means for mounting said clockwork mechanism on said mounting plate includes means for adjusting the spacing between said clockwork meachanism and said plate.

8. The assembly of claim 1, wherein said chime rods extend downwardly from said gongblock and are positioned between said mounting plate and said clockwork mechanism.

* * * * *